US005311743A

United States Patent [19]

Ansart et al.

[11] Patent Number: 5,311,743

[45] Date of Patent: May 17, 1994

[54] GAS SEPARATOR FOR A COMBUSTION CHAMBER

[75] Inventors: Denis R. H. Ansart, Bois le Roi; Denis J. M. Sandelis, Nangis, both of France

[73] Assignee: Societe Nationale d'Etude et de Construction de Moteurs d'Aviation "S.N.E.C.M.A.", Paris, France

[21] Appl. No.: 59,752

[22] Filed: May 12, 1993

[30] Foreign Application Priority Data

May 13, 1992 [FR] France ..... 92 05771

[51] Int. Cl.[5] ..... F23R 3/34

[52] U.S. Cl. ..... 60/747; 60/752

[58] Field of Search ..... 60/747, 746, 752, 733, 60/748, 757

[56] References Cited

U.S. PATENT DOCUMENTS 3,934,409 1/1976 Quillevere et al. .

FOREIGN PATENT DOCUMENTS 1248897 11/1960 France .
76734 10/1961 France .
1286562 1/1962 France .
260957 4/1949 Switzerland .
948128 1/1964 United Kingdom .
2003554 3/1979 United Kingdom .
2010408 6/1979 United Kingdom .
2013788 8/1979 United Kingdom .

*Primary Examiner*—Richard A. Bertsch
*Assistant Examiner*—Timothy S. Thorpe
*Attorney, Agent, or Firm*—Bacon & Thomas

[57] ABSTRACT

A gas separation assembly for a gas turbine engine combustion chamber is disclosed having spaced apart partition walls which extend through an end of the combustion chamber so as to define an oxidizer chamber which communicates with a source of oxidizer. Downstream ends of the spaced apart partition walls within the combustion chamber are interconnected to a plurality of generally "V" shaped spacers oriented such that the apex of the "V" configuration faces toward the end of the combustion chamber. Downstream edges of the partition walls are notched, also in a "V" shaped configuration such that the notches extend between opposite legs of the spacers. The spacers are circumferentially spaced apart so as to define passageways which communicate with the oxidizer chamber to enable oxidizer to pass through the gas separation assembly into the combustion chamber. The notches in the downstream edges of the partition walls form a series of generally radially extending flues to facilitate heat transfer between the combustion zones by convection. The design also eliminates the hot spots of the known prior art separation assemblies.

4 Claims, 3 Drawing Sheets

FIG. 2
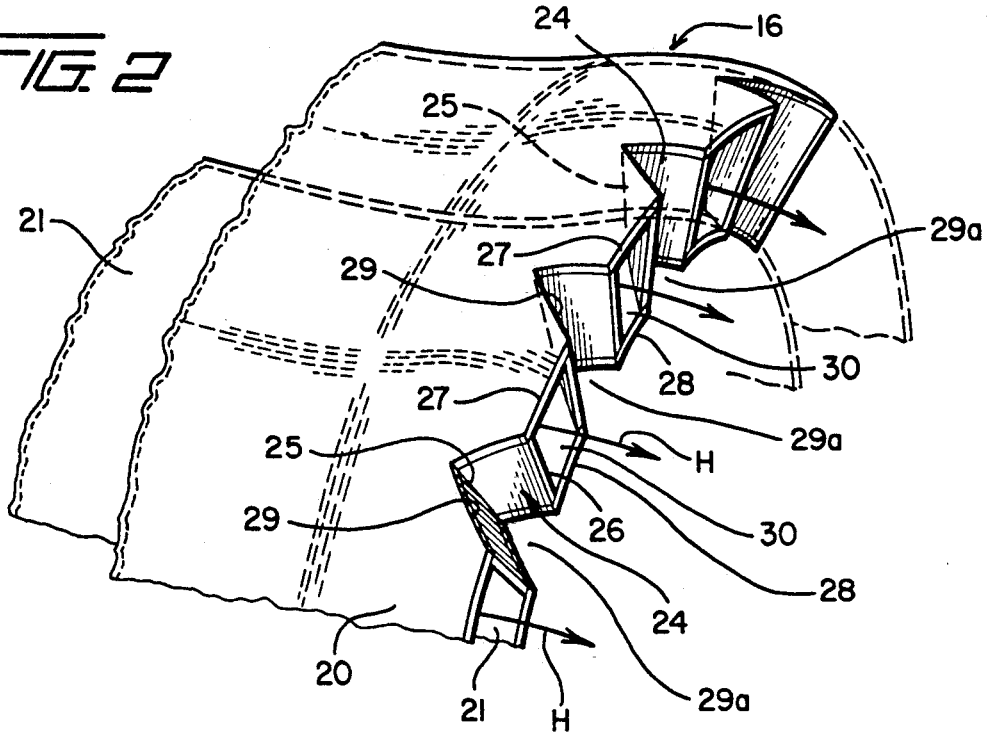
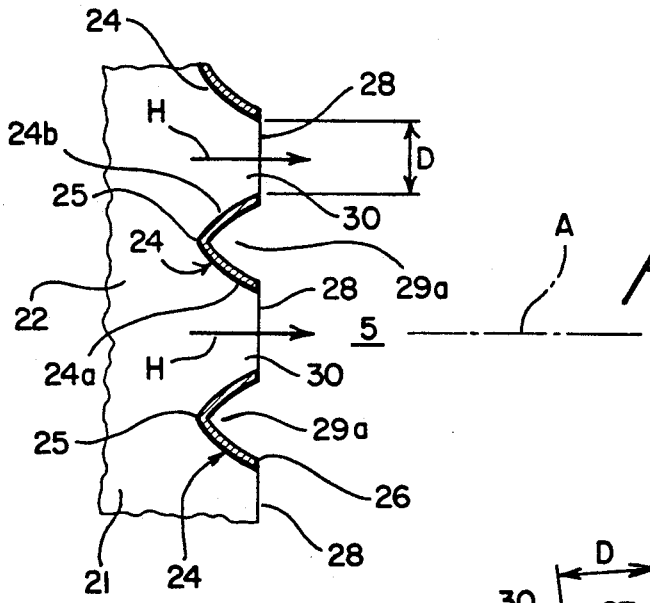
FIG. 3
FIG. 4
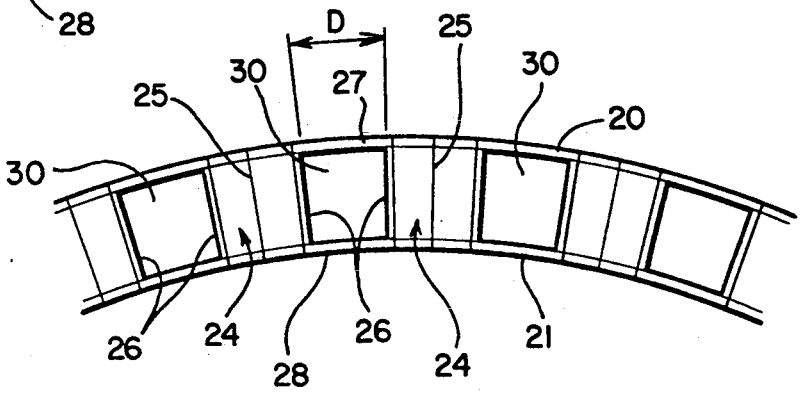

GAS SEPARATOR FOR A COMBUSTION CHAMBER

BACKGROUND OF THE INVENTION

The present invention relates to a gas separator assembly for a gas turbine engine combustion chamber, more particularly such an assembly which improves the heat exchange between combustion zones within the combustion chamber and eliminates high temperature concentrations on the assembly.

Combustion chambers having a generally annular configuration extending about an axis of symmetry and defined by opposite sidewalls and an end wall are known in the art. It is also known to utilize two distinct arrays of fuel injector nozzles to inject fuel into two combustion zones within the combustion chamber. Typically, one of the arrays of the fuel injectors are utilized to supply fuel to the combustion chamber in a first operational mode of the gas turbine engine, such as under low power conditions, while the other array of fuel injector nozzles inject fuel into the combustion chamber under second operational conditions, such as full power. It is also known to have oxidizer intake passageways through the end of the combustion chamber in order to supply oxidizer to support the combustion of the fuel/oxidizer mixture, as well as to provide a gas separating assembly attached to the end of the combustion chamber and inserted between the respective fuel injector arrays. A typical example of such structure can be found in U.K. patent application 2 010 408.

The design of the gas separator assembly is critical to the combustion chamber design in order to provide the proper heat exchange between the combustion zones in the chamber. The known gas separation assemblies, however, do not provide the optimum heat exchange due to the presence of "dead" zones wherein such heat exchange is nonexistent or inadequate. In particular, the known separation assemblies do not provide any heat exchange by convection. Also, the known gas separation assemblies comprise large projections inside the combustion chamber and tend to form hot spots thereon which interfere with the combustion process.

SUMMARY OF THE INVENTION

A gas separation assembly for a gas turbine engine combustion chamber is disclosed having spaced apart partition walls which extend through an end of the combustion chamber so as to define an oxidizer chamber which communicates with a source of oxidizer. Downstream ends of the spaced apart partition walls within the combustion chamber are interconnected to a plurality of generally "V" shaped spacers oriented such that the apex of the "V" configuration faces toward the end of the combustion chamber. Downstream edges of the partition walls are notched, also in a "V" shaped configuration such that the notches extend between opposite legs of the spacers. The spacers are circumferentially spaced apart so as to define passageways which communicate with the oxidizer chamber to enable oxidizer to pass through the gas separation assembly into the combustion chamber.

The notches in the downstream edges of the partition walls form a series of generally radially extending flues to facilitate heat transfer between the combustion zones by convection. The design also eliminates the hot spots of the known prior art separation assemblies.

The partition walls of the gas separation assembly extend through the end of the combustion chamber such that the separation assembly is located generally between the two combustion zones. Fuel injectors for injecting fuel into the respective combustion zones are located on either side of the gas separation assembly.

In an alternative embodiment, additional, generally triangular spacers are located circumferentially between adjacent first spacers and are oriented such that a base of the triangle faces generally towards the end of the combustion chamber. In this particular embodiment, the oxidizer passageways are defined between sides of adjacent first and second spacers and are oriented such that the oxidizer passes into the combustion chamber obliquely to a longitudinal axis of the combustion chamber.

BRIEF DESCRIPTION OF THE DRAWINGS

FIG. 2 is a partial, perspective view illustrating a first embodiment of the gas separation assembly according to the present invention.

FIG. 3 is a partial, cross-sectional view taken along line III—III in FIG. 1.

FIG. 4 is a partial, rear view of the gas separation assembly taken in the direction of arrow F in FIG. 1.

DETAILED DESCRIPTION OF THE PREFERRED EMBODIMENTS

Figure 1:
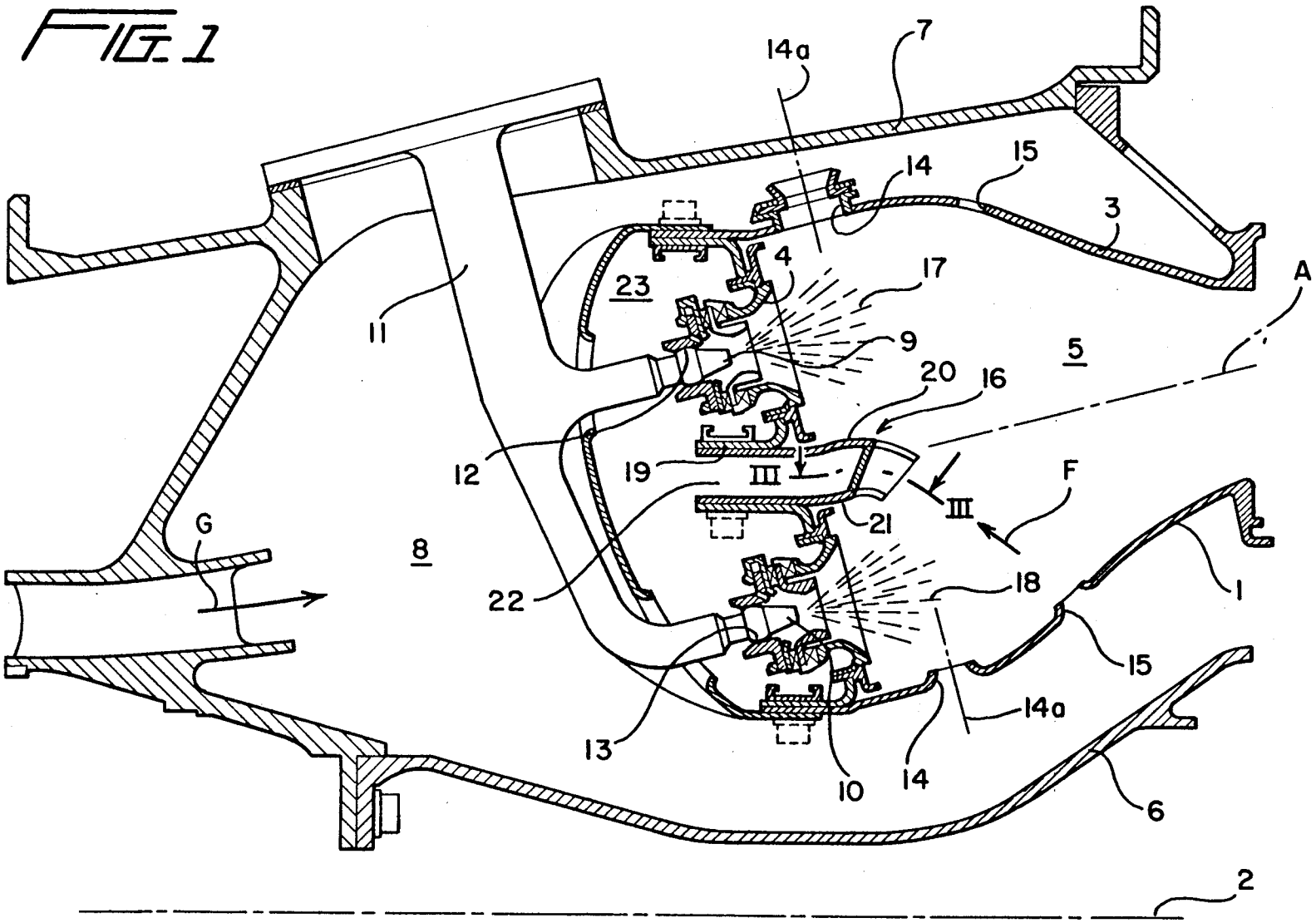
FIG. 1 is a partial, longitudinal, cross-sectional view of a combustion chamber incorporating the gas separation assembly according to the present invention.

The combustion chamber, as illustrated in FIG. 1, comprises an inner wall 1 having a generally annular configuration about axis of symmetry 2, an outer annular wall 3, also concentric about axis of symmetry 2, the inner and outer annular walls being interconnected at an upstream end by end wall 4. Together, the walls 1, 3 and 4 define a combustion chamber 5. The combustion chamber may be enclosed by an inner casing 6 and an outer casing 7, both symmetrical about axis 2 and which define between them a space 8 which is fed a pressurized oxidizer from a source (not shown) in the direction of arrow G. As is well known in the art, the oxidizer may be provided from a compressor stage of the gas turbine engine.

Fuel injection nozzles 9 and 10 are connected to fuel supply manifold 11 and extend through the end wall 4 of the combustion chamber so that they may inject fuel into the combustion zones 17 and 18, respectively. In order to provide the proper fuel/air mixture to support combustion within the combustion zones, inner and outer walls 1 and 3 define primary oxidizer intake orifices 14 which communicate with the space 8 to enable oxidizer to pass into the combustion zones of the combustion chamber. Walls 1 and 3 also define dilution oxidizer intake orifices 15, which also communicate with the oxidizer space 8 and enable the combustion gases to be diluted, in known fashion.

The gas separation assembly according to the present invention is illustrated at 16 and, as can be seen, extends through the end wall 4 and into the combustion chamber 5 generally between the combustion zones 17 and 18. The gas separation assembly 16 extends into the combustion chamber 5 approximately to the axial location of the axes 14*a* of the primary oxidizer intake orifices 14. The gas separation assembly 16 may be affixed to the end wall 4 by known means, such as welds 19.

A first embodiment of the gas separation assembly according to the present invention is illustrated in FIGS. 2–4. As can be seen, the gas separation assembly 16 comprises first and second spaced apart partition walls 20 and 21, each concentric about the axis of symmetry 2 and which extend generally parallel to upstream portions of the inner and outer walls 1 and 3 of the combustion chamber. The spaced apart partition walls 20 and 21 define therebetween an oxidizer chamber 22 and both are affixed to and extend through the end wall 4 of the combustion chamber. The oxidizer chamber 22 communicates with the oxidizer space 8 via chamber 23 such that oxidizer is supplied to the oxidizer chamber 22.

A plurality of first spacers 24 extend between the first and second partition walls adjacent to their downstream end portions (those portions which extend furthermost into the combustion chamber) and are oriented substantially radially with respect to the axis of symmetry 2. As can be seen, the first spacers 24 have a generally "V"-shaped cross-sectional configuration and are oriented such that the apex 25 of the "V" shape faces upstream, towards the end wall 4 of the combustion chamber. Each spacer 24 comprises a pair of opposite legs 24*a*, 24*b*, having downstream edges 26 which are generally coplanar with the downstream edges 27, 28 of the partition walls 20 and 21, respectively. Adjacent downstream edges of adjacent sides of the first spacers are circumferentially separated by a distance D, which is greater than zero.

The downstream edge portions of the partition walls 20 and 21 define a plurality of notches 29 which are also generally "V" shaped and which extend between the legs of each first spacer. The notches 29 and the spacer legs 24*a*, 24*b* form a plurality of flues 29*a* which are oriented generally radially with respect to the axis of symmetry 2. An oxidizer passageway 30 is defined between adjacent first spacers such that the passageways 30 allow oxidizer from the oxidizer chamber 22 to pass into the combustion chamber in the direction of arrows H, best illustrated in FIG. 3. As can be seen, in this embodiment, the oxidizer enters the combustion chamber generally parallel to the longitudinal axis A of the combustion chamber.

Figure 5:
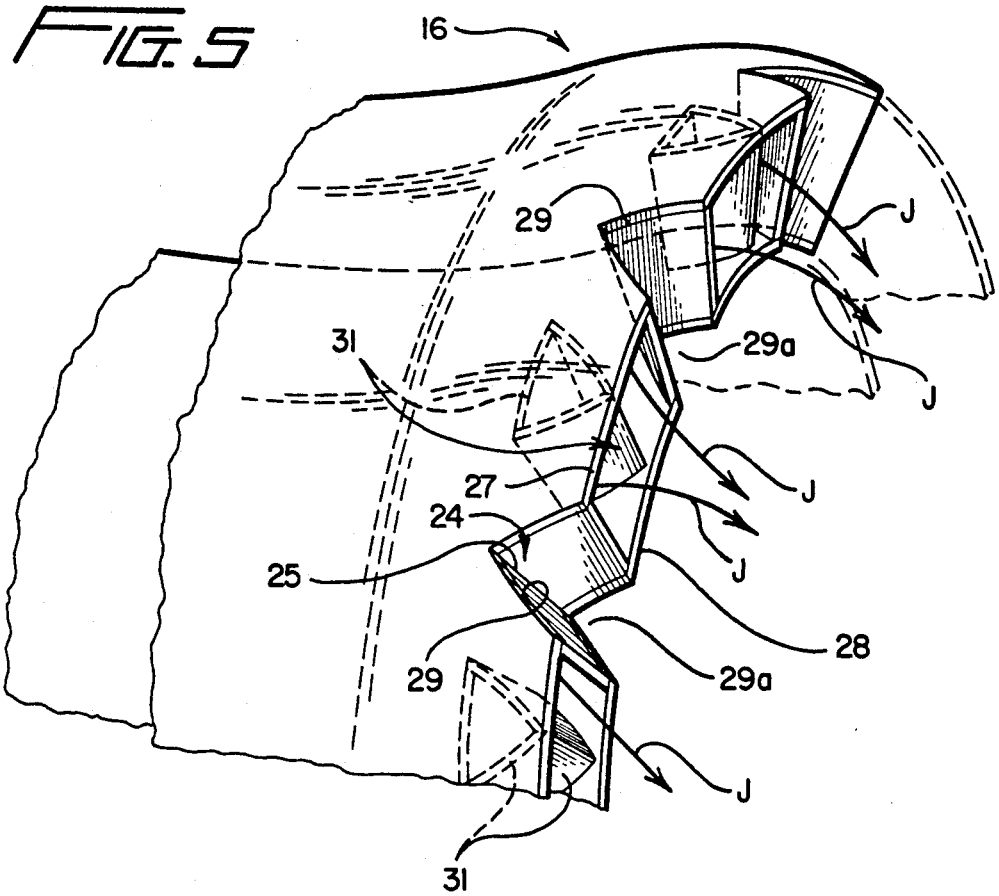
FIG. 5 is a partial, perspective view, similar to FIG. 2, but illustrating a second embodiment of the gas separation assembly according to the present invention.
Figure 6:
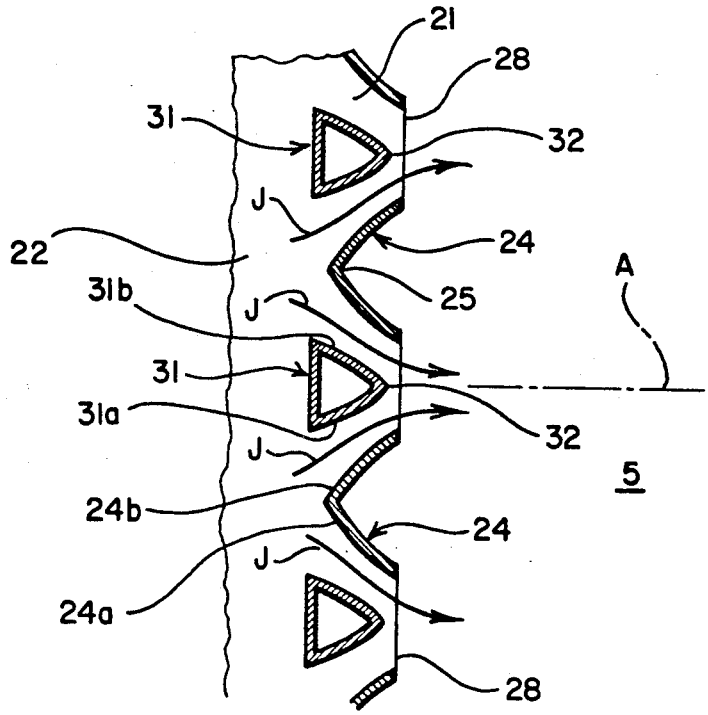
FIG. 6 is a partial, cross-sectional view, similar to FIG. 3, but illustrating the second embodiment of the invention of FIG. 5.

The embodiment illustrated in FIGS. 5 and 6 includes all of the structure of the embodiment illustrated in FIGS. 2 through 4 plus the addition of a plurality of second spacers 31 having a generally triangular configuration and located between adjacent first spacers 24. The second spacers 31 extend between the first and second partition walls 20 and 21 adjacent their downstream end portions and, as can be seen, have a generally triangular-shaped cross-sectional configuration. The spacers 31 may be fixedly attached to the first and second partition walls by any known means, such as by welding. Again, the second spacers 31 extend generally radially with respect to the axis of symmetry 2 and are oriented such that a base of the triangular cross-section faces upstream, towards the end wall 4 of the combustion chamber. Two sides 31*a*, 31*b*, of the second spacers 31 are adjacent to two of the first spacers 24 so as to define therebetween oxidizer passageways which communicate with the oxidizer space 22. In this embodiment, the oxidizer passageways permit oxidizer to pass from the oxidizer chamber 22 into the combustion chamber 5 in the directions of arrows J. The directions of arrows J are oblique to the axis A of the combustion chamber.

A downstream edge 32 of each of the second spacers 31 is located adjacent to the downstream edges 27 and 28 of the partition walls 20 and 21, respectively. This embodiment, as in the first embodiment, defines a plurality of generally radial flues 29 to facilitate heat exchange between the combustion zones by convection.

Although FIG. 1 illustrates only two fuel injection nozzles, 9 and 10, it is to be understood that the fuel injection nozzles are arranged in annular arrays which arrays are generally concentric about the axis of symmetry 2.

The plurality of flues 29 defined by the gas separation assembly according go the present invention allows gas circulation, in particular by convection, between the combustion zones 17 and 18, thus avoiding the presence of "dead" zones in which no circulation takes place (particularly adjacent the downstream edges 27 and 28) and, as a result, the invention eliminates the dangers caused by hot points forming on the known gas separation assemblies. Also, the intake of the primary oxidizer directly through the end wall 4 of the combustion chamber in the directions of arrows H or J, allows the combustion chamber structure to be axially shortened even when a portion of the primary oxidizer is supplied from orifices formed in the sidewalls of the combustion chamber.

The foregoing description is provided for illustrative purposes only and should not be construed as in any way limiting this invention, the scope of which is defined solely by the appended claims.

We claim:

1. A gas separation assembly for a gas turbine combustion chamber having a longitudinal axis of symmetry and defined by spaced apart side walls and an end wall, and at least two fuel injection nozzles extending through the end wall to inject fuel into two combustion zones, the gas separation assembly comprising:

a) first and second spaced apart partition walls extending through the end wall about the axis of symmetry between the at least two fuel injection nozzles and defining therebetween an oxidizer chamber, the first and second partition walls each having a downstream edge portion located in the combustion chamber;

b) a plurality of first spacers extending between the first and second partition walls adjacent to their downstream edge portions, each of the spacers having a pair of legs each defining a downstream edge and arranged in a generally "V" shaped configuration with the apex of the "V" configuration extending toward the end wall of the combustion chamber, the plurality of spacers laterally spaced apart from each other so as to define oxidizer passageways therebetween in communication with the oxidizer chamber and the combustion chamber so as to enable oxidizer to pass into the combustion chamber;

c) downstream partition wall edges defined by each partition wall located substantially co-planar with the downstream edges of the legs of the first spacers; and, d) notches defined by the downstream edge portions of the first and second partition walls such that the notches extend toward the end wall between the legs of each first spacer.

2. The gas separation assembly of claim 1 wherein the vertex of each generally V-shaped first spacer extends generally radially with respect to the axis of symmetry.

3. The gas separation assembly of claim 2 wherein each downstream edge extends generally radially with respect to the axis of symmetry.

4. The gas separation assembly of claim 1 further comprising a plurality of second spacers extending between the first and second partition walls, the second spacers each having a generally triangular cross-sectional configuration oriented such that a side of the triangular cross-sectional configuration faces the end of the combustion chamber, and located between adjacent first spacers so as to define the oxidizer passageways therebetween.

* * * * *